US008794694B2

(12) United States Patent
Parsons et al.

(10) Patent No.: US 8,794,694 B2
(45) Date of Patent: Aug. 5, 2014

(54) FOOT ISOLATION PLATFORM

(71) Applicant: BAE Systems Aerospace & Defense Group Inc., Phoenix, AZ (US)

(72) Inventors: Curtis Phillip Parsons, Gilbert, AZ (US); Gregory Alan Mowry, Phoenix, AZ (US)

(73) Assignee: BAE Systems Aerospace & Defense Group Inc., Phoenix, AZ (US)

( * ) Notice: Subject to any disclaimer, the term of this patent is extended or adjusted under 35 U.S.C. 154(b) by 0 days.

(21) Appl. No.: 13/679,232

(22) Filed: Nov. 16, 2012

(65) Prior Publication Data

US 2013/0127208 A1 May 23, 2013

Related U.S. Application Data

(60) Provisional application No. 61/560,937, filed on Nov. 17, 2011.

(51) Int. Cl.
*B60J 7/00* (2006.01)

(52) U.S. Cl.
USPC ..... 296/193.07

(58) Field of Classification Search
USPC ..... 296/193.07, 187.08
See application file for complete search history.

(56) References Cited

U.S. PATENT DOCUMENTS

| | | | | | |
|---|---|---|---|---|---|
| 829,385 | A * | 8/1906 | Brennan, Jr. | ..... | 217/60 E |
| 2,332,064 | A * | 10/1943 | Duffy | ..... | 74/526 |
| 2,341,080 | A * | 2/1944 | Burkholder | ..... | 297/423.46 |
| 3,059,960 | A * | 10/1962 | Komorowski et al. | ..... | 296/64 |
| 3,653,715 | A * | 4/1972 | Drabert et al. | ..... | 297/423.45 |
| 3,860,284 | A * | 1/1975 | Lichtig | ..... | 296/75 |
| 4,955,658 | A * | 9/1990 | Graves | ..... | 296/75 |
| 4,991,900 | A * | 2/1991 | White | ..... | 296/75 |
| 5,596,906 | A * | 1/1997 | Lin | ..... | 74/478 |
| 6,371,511 | B1 * | 4/2002 | Kitagawa | ..... | 280/730.1 |
| 6,761,389 | B2 * | 7/2004 | Akasaka et al. | ..... | 296/75 |
| 6,779,431 | B2 | 8/2004 | Honlinger | | |
| 7,000,722 | B2 * | 2/2006 | Artis et al. | ..... | 180/170 |
| 7,628,440 | B2 * | 12/2009 | Bernhardsson et al. | ... | 296/37.14 |
| 7,946,641 | B2 * | 5/2011 | Ohtsubo et al. | ..... | 296/75 |
| 7,967,358 | B2 * | 6/2011 | Shukuri et al. | ..... | 296/75 |
| 8,444,203 | B2 * | 5/2013 | Ohtsubo et al. | ..... | 296/75 |
| 2007/0176456 | A1 * | 8/2007 | Ohtsubo et al. | ..... | 296/75 |
| 2010/0141001 | A1 * | 6/2010 | Matano et al. | ..... | 297/284.8 |
| 2010/0244485 | A1 * | 9/2010 | Tanaka et al. | ..... | 296/187.08 |
| 2010/0244534 | A1 * | 9/2010 | Driessen et al. | ..... | 297/423.35 |
| 2011/0233967 | A1 * | 9/2011 | Ohtsubo et al. | ..... | 296/193.07 |
| 2012/0049570 | A1 | 3/2012 | Aizik | | |
| 2012/0061996 | A1 * | 3/2012 | Gulley | ..... | 296/193.07 |
| 2013/0234492 | A1 * | 9/2013 | Driessen et al. | ..... | 297/423.25 |

* cited by examiner

*Primary Examiner* — Kiran B Patel
(74) *Attorney, Agent, or Firm* — Kane Kessler, P.C.; Paul E. Szabo

(57) ABSTRACT

A foot isolation platform for a vehicle includes a base for connection with the vehicle floor to be movable with the vehicle floor; a foot support movable relative to the base and having an upper surface for supporting the feet of the vehicle occupant above the base; and an isolation member connected in a force-transmitting relationship between the base and the foot support. The isolation member supports the foot support in an extended position above the base. The isolation member acts to isolate the foot support from the vehicle floor in the event of rapid upward movement of the vehicle floor thereby to help protect the lower extremities of the vehicle occupant.

13 Claims, 10 Drawing Sheets

FOOT ISOLATION PLATFORM

RELATED APPLICATIONS

This application is a nonprovisional of, and claims the benefit of the filing date of, U.S. Provisional Application No. 61/560,937, filed Nov. 17, 2011, the entire disclosure of which is hereby incorporated by reference.

BACKGROUND OF THE INVENTION

In some vehicles, such as military vehicles, it is desirable to support the lower legs of a vehicle occupant in a position up off the vehicle floor, by an amount sufficient to avoid floor deformation or upward movement in the event of a mine blast under the vehicle. Specifically, it is desirable to provide a structure that (a) holds the occupant's feet at a location spaced upward from the vehicle floor, while (b) not being rigid enough to transmit a significant amount of force into the occupant's feet when the floor moves suddenly upward. In this manner, the occupant's feet are "isolated" from the floor.

It is known to mount a footrest rigidly on a seat for a vehicle occupant, with the footrest elevating the occupant's feet up off the vehicle floor. It is also known to use an energy absorbing device that constitutes a second floor suspended on airbags, as shown in U.S. Pat. No. 6,779,431.

Figure 11:
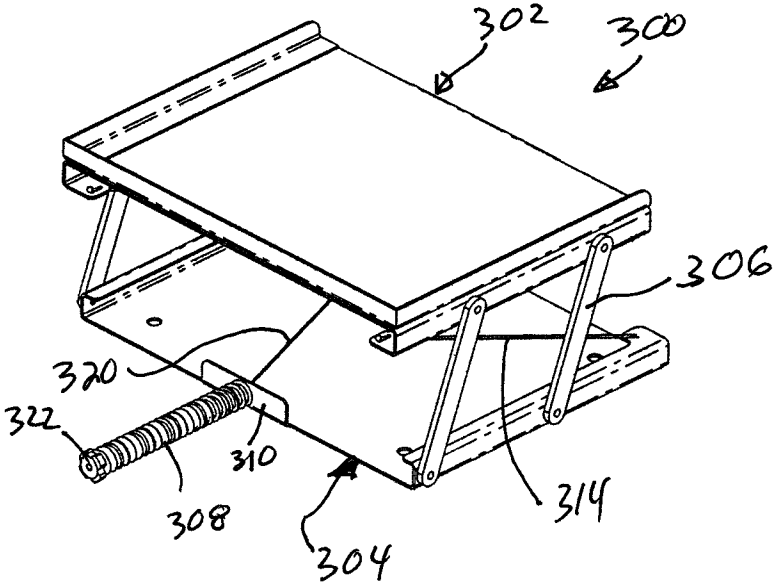
Figure 12:
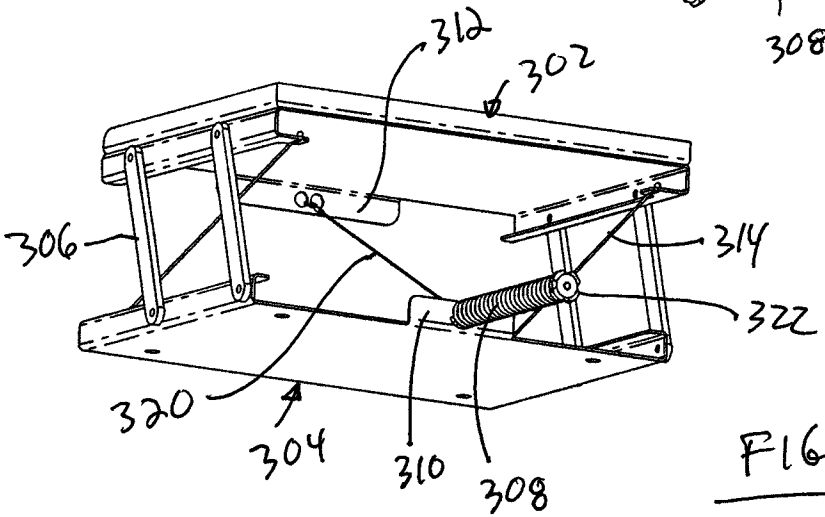
Figure 13:
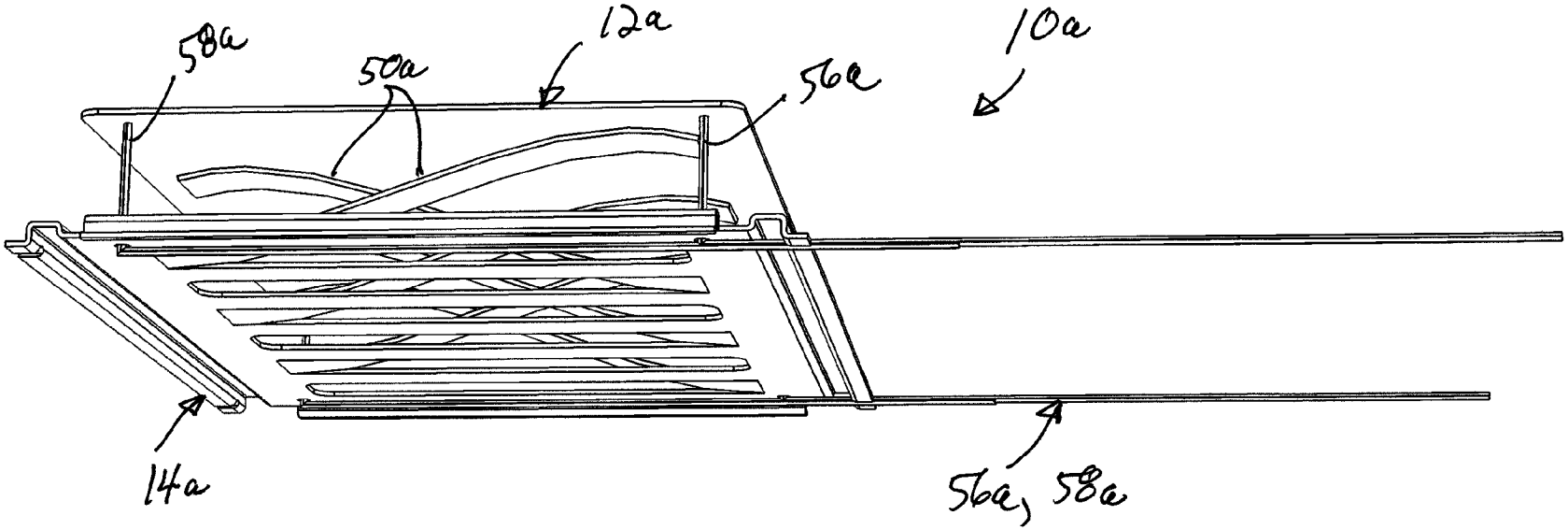

Fig, 11 is a perspective view of a foot isolation platform that is a fourth embodiment of the invention;

FIG. 12 is another perspective view of the foot isolation platform of FIG. 11; and FIG. 13 is a perspective view of a foot isolation platform that is a fifth embodiment of the invention.

DETAILED DESCRIPTION

Figure 1:
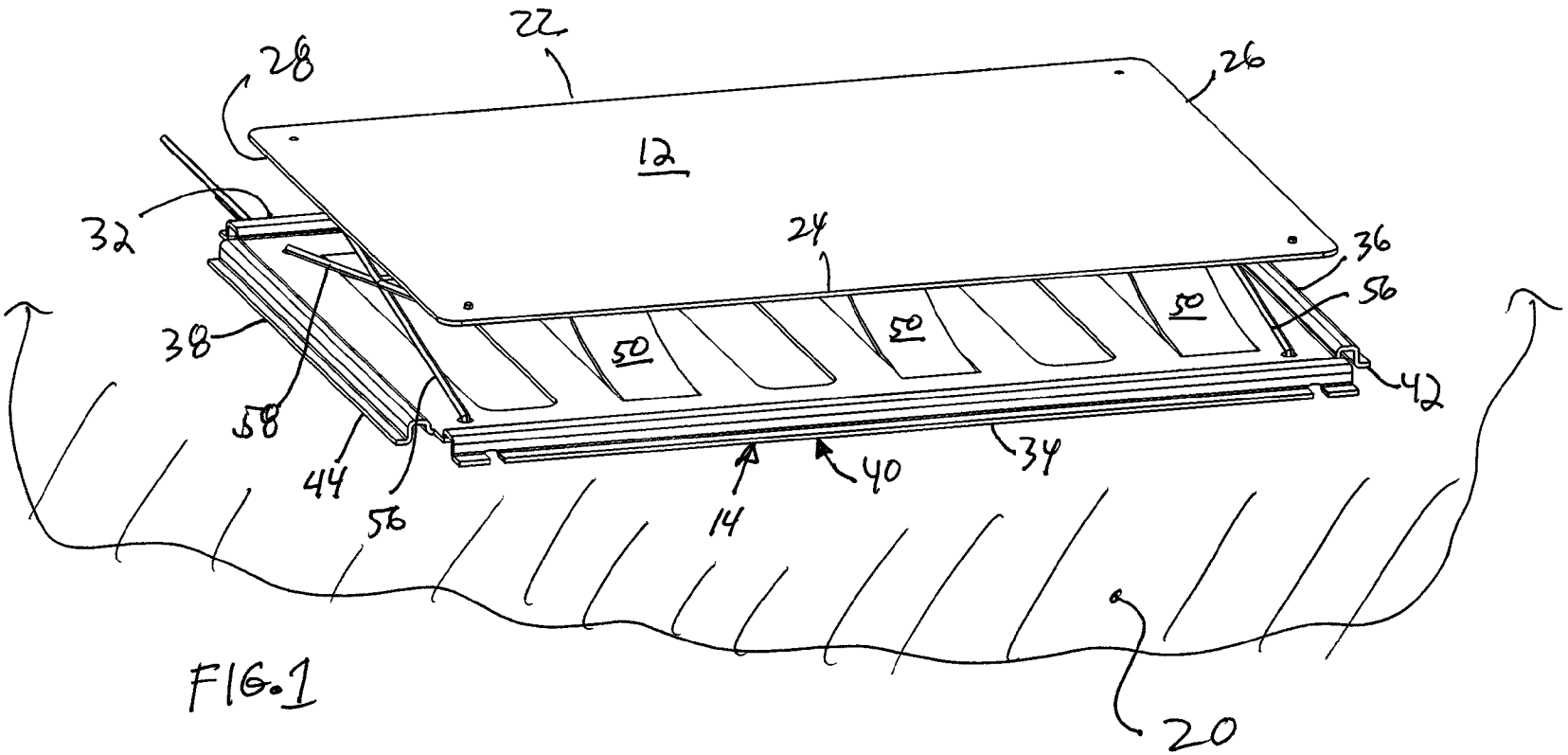
FIG. 1 is a front perspective view of a foot isolation platform that is a first embodiment of the invention, shown in an extended position.
Figure 2:
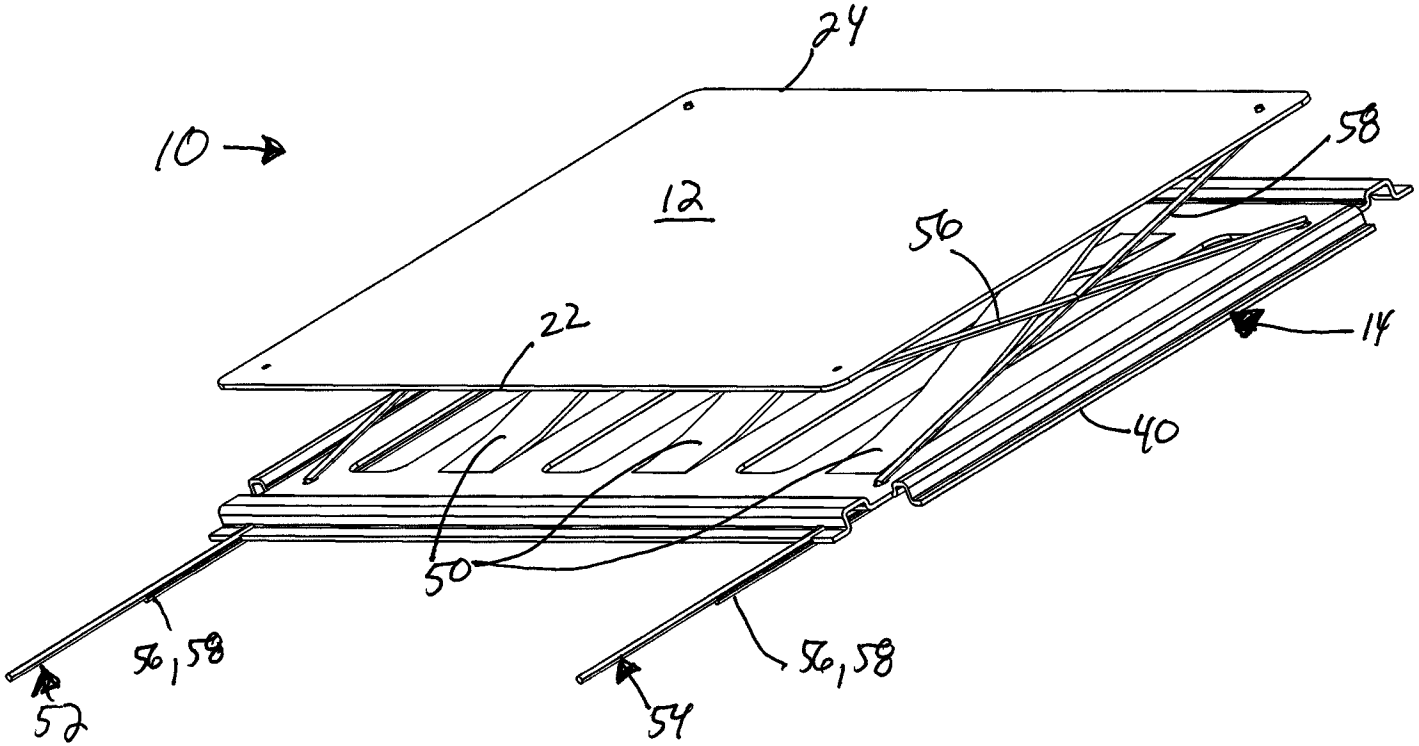
FIG. 2 is a back perspective view of the foot isolation platform of FIG. 1.
Figure 3:
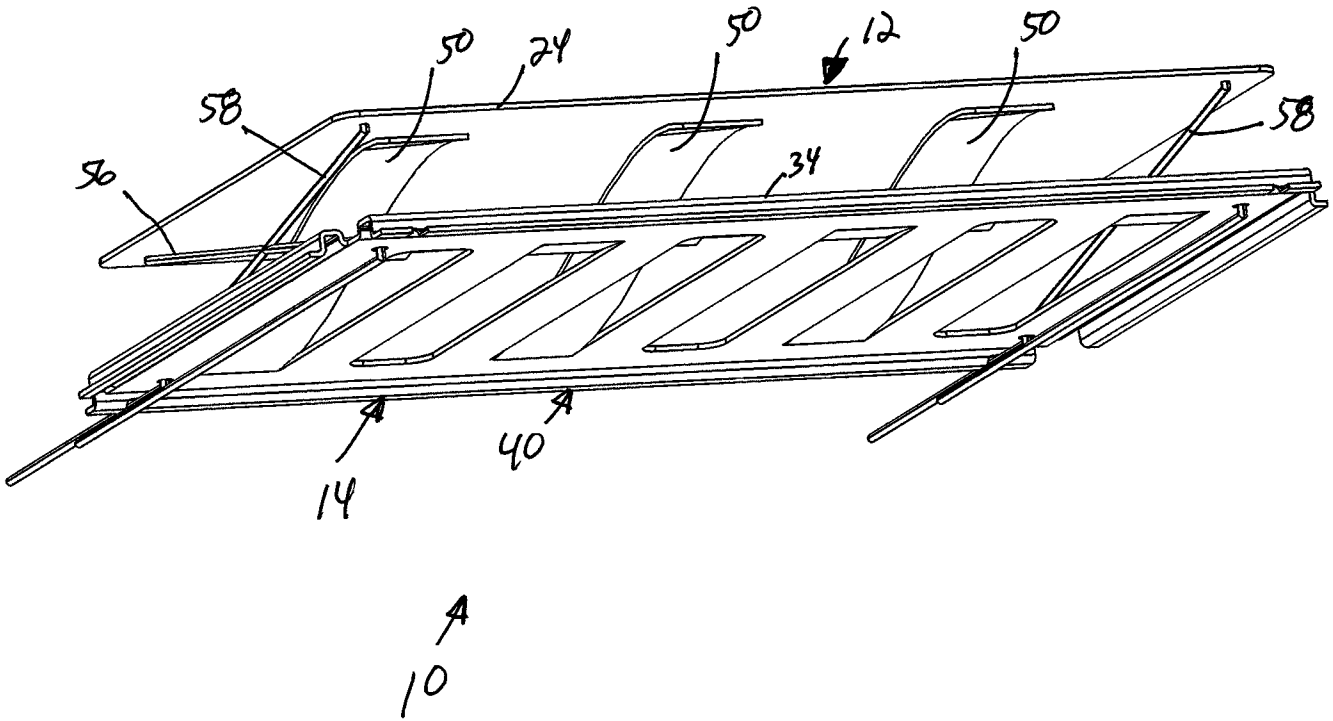
FIG. 3 is a bottom perspective view of the foot isolation platform of FIG. 1.
Figure 4:
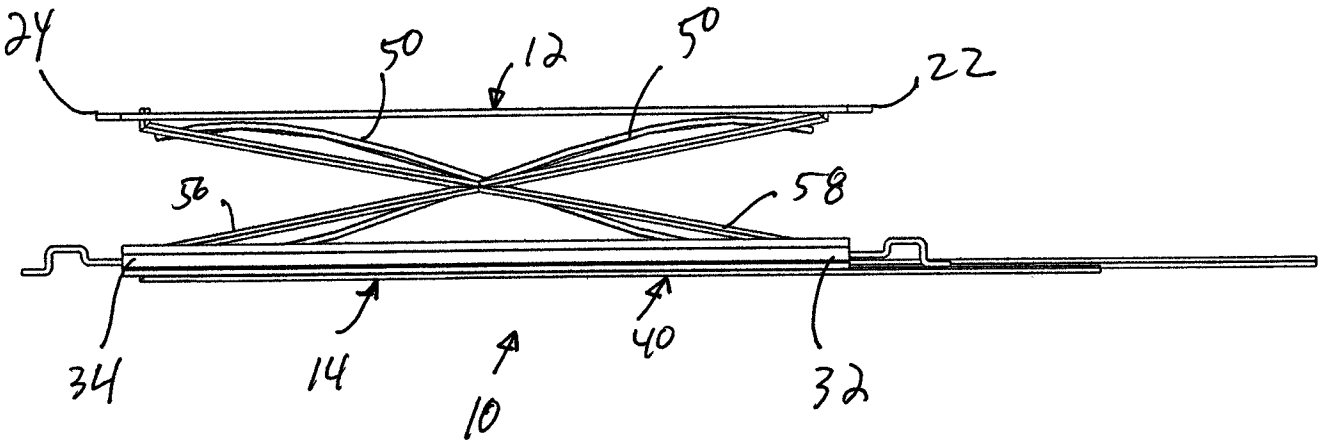
FIG. 4 is a side elevational view of the foot isolation platform of FIG. 1.

The present invention relates to a foot isolation platform for use in a vehicle. The invention is applicable to foot isolation platforms of varying constructions. As representative of the invention, FIG. 1 illustrates a foot isolation platform 10 that is a first embodiment of the invention.

The platform 10 includes generally a foot support 12, supported on a leaf spring base 14, connected by retraction cables 56 and 58. The platform 10 is supported on and may be secured to a vehicle floor, a portion of which is shown schematically at 20.

The foot support 12 is the portion of the platform 10 on which the occupant's feet and legs (lower extremities) rest. For purposes of the description herein, the foot support 12 is designated as having a front edge 22, a back edge 24, a left end 26, and a right end 28.

A foot isolation platform in accordance with the present invention is preferably, but not necessarily, made from all metallic materials. It is thus nonflammable. As one example, in the illustrated embodiment, the platform base 14 may be formed as one piece of metal cut and formed to shape, and the foot support 12 is a separate piece of metal. Alternatively, the platform base 14 could be formed from multiple pieces if desired. Further, metal construction may not be required; plastic or composite materials could be used as well.

The base 14 has a main body portion 40 for connection with the vehicle floor 20. The main body portion 40 may have attachment features for securing the base 14 (and thus the entire platform 10) to the vehicle floor 20. The main body portion 40 of the base 14 includes end rails 42 and 44 at the left and right ends, respectively. For purposes of the description herein, the base 14 is designated as having a front edge 32, a back edge 34, a left end 36, and a right end 38.

The base 14 also includes a number of leaf springs 50 that in their free state project upward from the main body portion 40. The leaf springs 50 are resilient spring members. In the illustrated embodiment there are six leaf springs 50. Three of the leaf springs 50 extend from the front edge 32 of the main body portion 40 of the base 14, and the remainder of the leaf springs 50 extend from the back edge 34 of the main body portion of the base.

The foot support 12 engages, near its front and back edges 22 and 24, the upper ends of the leaf springs 50. Because of the resilience of the leaf springs 50, the foot support 12 is movable vertically relative to the main body portion 40 of the base 14.

A plurality of retraction cables also interconnect the base 14 and the foot support 12 in the illustrated embodiment. In this case, two pairs 52 and 54 of cables are provided, one pair at each end of the platform 10. In each pair, a first cable 56 extends from the front edge 32 of the base 14, along the end rail, then up and forward to connect with the front edge 22 of the foot support 12. The second cable 58 in that pair extends from the front edge 32 of the base 14, up and rearward to connect with the back edge 24 of the foot support 12. The opposite ends (not shown) of the cables 56 and 58 may be connected with a device (not shown) that selectively pulls on the cables, for example, a handle, or a seat position device.

In use of the platform 10, the main body portion 40 of the base 14 is secured to the vehicle floor 20. The leaf springs 50 hold the foot support 12 upward away from the main body portion 40 of the base 14 and from the vehicle floor 20, for example, by the end rails 42 and 44.

Figure 5:
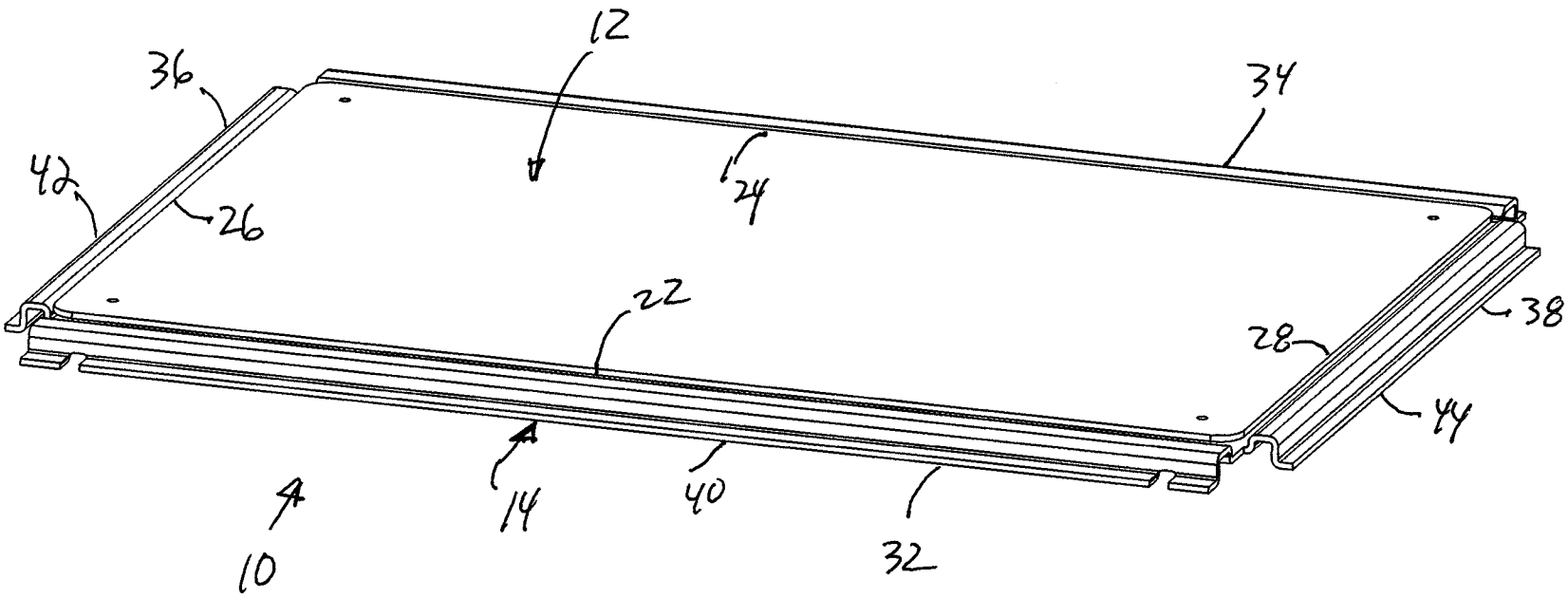
FIG. 5 is a top perspective view of the foot isolation platform of FIG. 1, shown in a retracted position.
Figure 6:
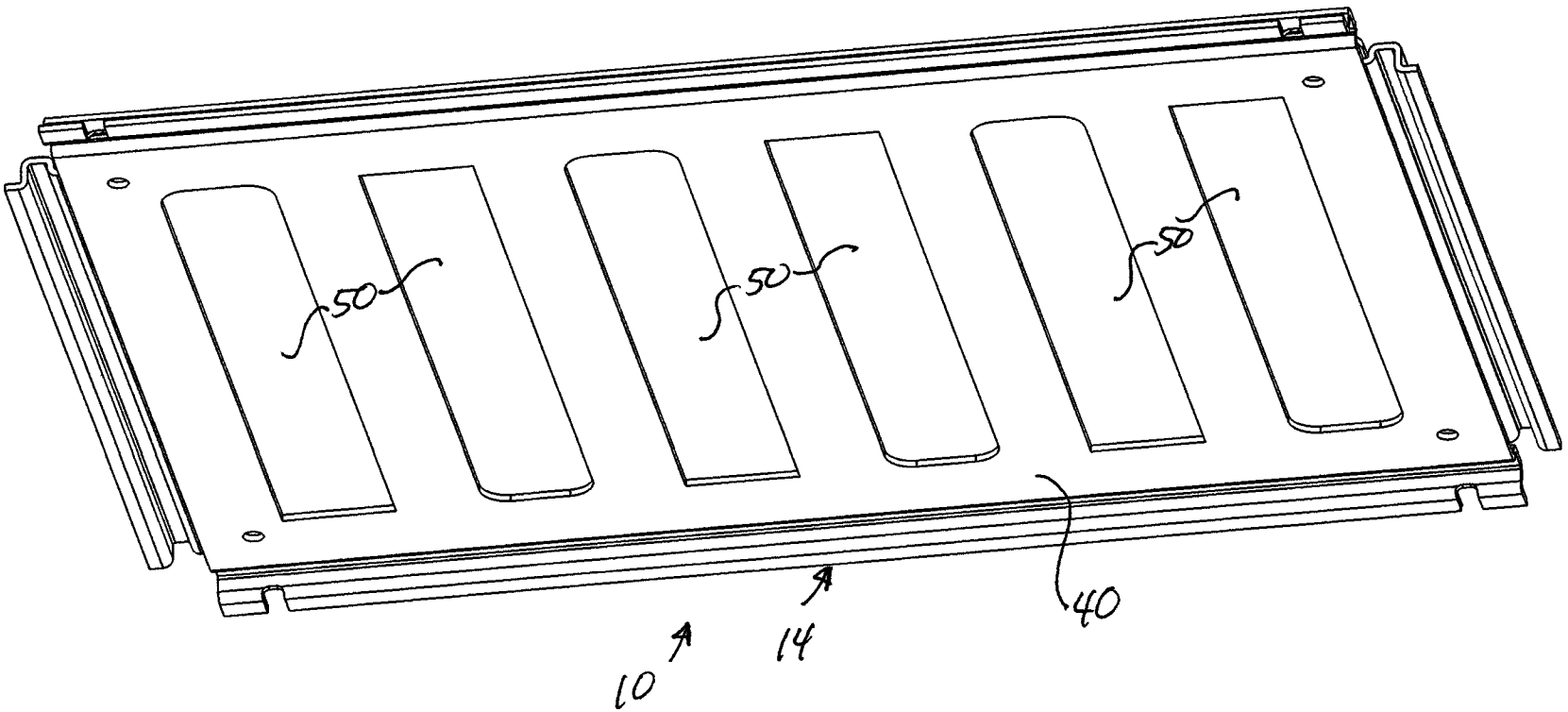
FIG. 6 is a bottom perspective view of the foot isolation platform of FIG. 1, shown in the retracted position.

At times it is desirable to collapse the platform 10 and hold down the foot support 12 in a position close to the vehicle floor 20. When the cables 56 and 58 are retracted, as by moving a handle or folding a seat pan to a particular position, the cables pull the foot support 12 downward, against the bias of the springs 50, to a retracted position as shown in FIGS. 5 and 6 against or overlying the main body portion 40 of the base 14. This position is useful when an occupant is getting into or out of the vehicle and needs to be able to step or move easily. This position of the platform 10 is also useful for carrying cargo.

When the pulling force on the cables 56 and 58 is thereafter released, the biasing force of the springs 50 pushes or holds the foot support 12 upward, away from the base main body portion 40, to an extended position as shown in FIG. 1. This position is useful to support the lower extremities of a vehicle occupant away from the vehicle floor 20. The leaf springs 50 are not rigid enough to transmit a significant amount of force into the occupant's feet if the vehicle floor moves suddenly upward. In this manner, the occupant's feet are "isolated" from the vehicle floor, and the leaf springs 50 act as an isolation member in the platform 10.

A means or mechanism other than the cables 56 and 58 may be used to help retract and hold the foot support 12 in position against the main body portion 40 of the base 14. For example, a catch may capture the foot support 12 when the platform 10 is compressed by an individual standing on it.

In the event of a mine blast under the vehicle, the vehicle floor 20 may be accelerated rapidly upward, and/or may deform upward, pushing the main body portion 40 of the base 14 upward also, and compressing the springs 50. Because the foot support 12 is spaced apart from the base 14, with no rigid connection between them, the foot support 12 and the occupant's lower extremities are spared the full force of this acceleration. The foot support 12 is preferably spaced upward, off the base main body portion 40 and off the vehicle floor 20, by an amount sufficient to prevent the vehicle floor and the base main body portion from contacting the foot support when this upward movement occurs. This can help to protect the lower extremities of the vehicle occupant.

The force of the upwardly moving base main body portion 40 is transmitted into the leaf springs 50. The lower ends of the leaf springs 50 start to move upward. The inertia of the foot support 12 and of the occupant's lower extremities acts against this force, and the springs 50 compress. Eventually, if the upward movement of the vehicle floor 14 is sufficient in duration and magnitude, the springs 50 may compress completely and the foot support 12 will then be engaged by the effect of the acceleration event.

The leaf springs 50 are advantageous in several aspects. First, because the springs constantly act between the base main body portion 40 and the foot support 12, the foot support is automatically spaced upward from the vehicle floor 20 without the need for any external motive force, such as an airbag that needs an air pressure source. Second, the springs 50 reduce part count in the platform 10, by being formed as one piece with the base 40. This manner of construction also reduces cost and complexity, as the manufacture of the base 40 with the leaf springs 50 is a very simple operation.

Third, the springs 50 stow (compress) into a very thin package when the platform 10 is collapsed; this is important to avoid providing a trip hazard, and to avoid impeding egress from the vehicle. Fourth, there is no need for any external motive force to hold the foot support 12 upward off the base 40, as there would be, for example, with a unit employing one or more compressed airbags. Fifth, the simple, all-metal construction of the platform 10 is durable and long-lasting when used in the intended environment, a military operating theater.

The platform 10 is preferably provided as a stand-alone foot isolation unit, for aftermarket upgrades to existing vehicles. There is a large demand for such units, and the platform 10 is especially well suited for that role. It is small, simple, and easy to install. The platform 10 can alternatively be built into a vehicle floor, to stow completely flush with the floor surface.

A platform in accordance with the present invention is preferably dimensioned to be able to support the legs and feet of an individual vehicle occupant. Alternatively, a platform in accordance with the present invention can be dimensioned to be able to support the legs and feet of several occupants across a wider vehicle seat.

The platform 10 is self-contained. As such, it contains within itself the apparatus that provides the motive force for holding the foot support 12 up off the base 40 in a non-rigid manner (in the illustrated embodiment, this apparatus is the leaf springs). This structure is preferably, as shown, contained within the envelope of (the volume defined by) the foot support and the base.

The leaf spring design of the platform 10 is inherently self-resetting; that is, after an event, it automatically returns itself to the starting (extended) position, without the need for application of any external force to accomplish that. To avoid any problem arising from resetting accelerations, it is feasible to fit a damper or a catch to the platform 10. A damper, extending between the base 14 and the foot support 12, would allow free motion to collapse the platform 10 (either manually or by an event), but damped motion to return it to the deployed position as the springs 50 return to their free state. This could help to avoid undesirably accelerating the foot support 12 upward after an event is concluded. A catch, acting between the foot support 12 and the base 14, could hold the platform 10 in the collapsed position and prevent it from automatically resetting until the catch is released.

In comparison to a prior art airbag system, the platform 10 is a mechanical isolation device, not a pressure vessel. As such, it is non-pneumatic, relying solely on simple mechanical parts. The spring force of the platform 12 is intrinsic to its mechanical nature. In the platform 10, the height of the foot support 12 off the vehicle floor 20 can easily be changed by changing the length of a tension element such as a cable. This may even be possible on the fly or in the field, to respond to a given threat level.

The retraction mechanism of the platform 10 acts to positively move the foot support from the extended position to a retracted position. That is, the force on the cables pulls the foot support 12 closer to the base 14. This is in contrast to an airbag system, in which the airbags are operable only to extend the system, and cannot retract it. For that reason also, the platform 10 is advantageous as it can be easily retracted on a moment's notice. In addition, the extended height of the platform can be reset easily by limiting the amount of movement in the cables.

The spring rate of a mechanical device, such as the leaf springs 50 of the platform 10, can be designed to be constant through the stroking motion, such as in a high vertical acceleration event. In contrast, the pressure in an airbag will increase as the volume decreases as occurs during stroking movement of an airbag system. The capability of the airbag to isolate the lower extremities becomes less and less as the airbag compresses and its internal pressure increases. In addition, an airbag system stores energy as the airbag compresses, producing a tendency to accelerate the lower extremities upward after the event.

In a retrofit program, it is logistically simpler to use a platform that is constructed in accordance with the present invention, rather than an airbag system, because it does not require connection to a vehicle air supply system. This also avoids having a flexible pressure vessel exposed to troop boots and to equipment that may be carried in the vehicle, thus providing increased durability. Further, a spring system deploys much more quickly than an air powered system.

Figure 7:
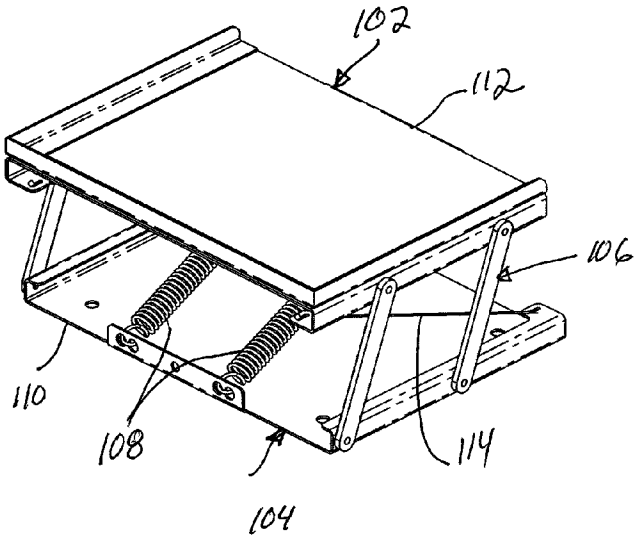
FIG. 7 is a perspective view of a foot isolation platform that is a second embodiment of the invention.
Figure 8:
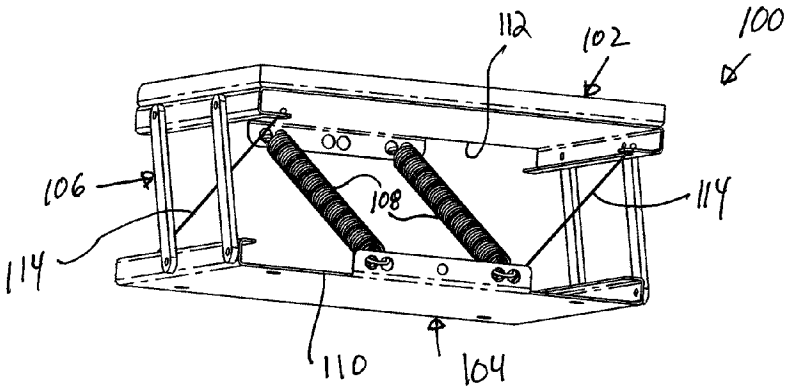
FIG. 8 is another perspective view of the foot isolation platform of FIG. 7.

FIGS. 7 and 8 illustrate a platform 100 that is a second embodiment of the invention. The platform 100 includes a foot support 102 and a base 104. The foot support 102 and the base 104 are connected by a four bar linkage system 106. An extension spring 108 is connected between the front edge 110 of the base 104 and the opposite back edge 112 of the foot support 102. The spring 108 acts between the base 104 and the foot support 102. The force of the spring 108 is set and cannot be varied.

When the platform 100 is collapsed (not shown), for example by stepping down onto the foot support 102, the spring 108 is stretched from its free state, between the base 104 and the foot support. When the collapsing force is removed, the spring 108 attempts to return to its free state, and shortens, trying to pull the two opposite platform edges 110 and 112 closer together. Because of the geometry of the linkage 106, this causes the foot support 102 to rise off the base 104

The platform 100 includes cables or tethers 114 on its sides, that are connected between the platform pieces 102 and 104, and that are arranged so that manually pulling on them acts against the force of the spring 108, to collapse the platform. The cables can also be used to set the height of the platform by setting them to an intermediate position.

Figure 9:
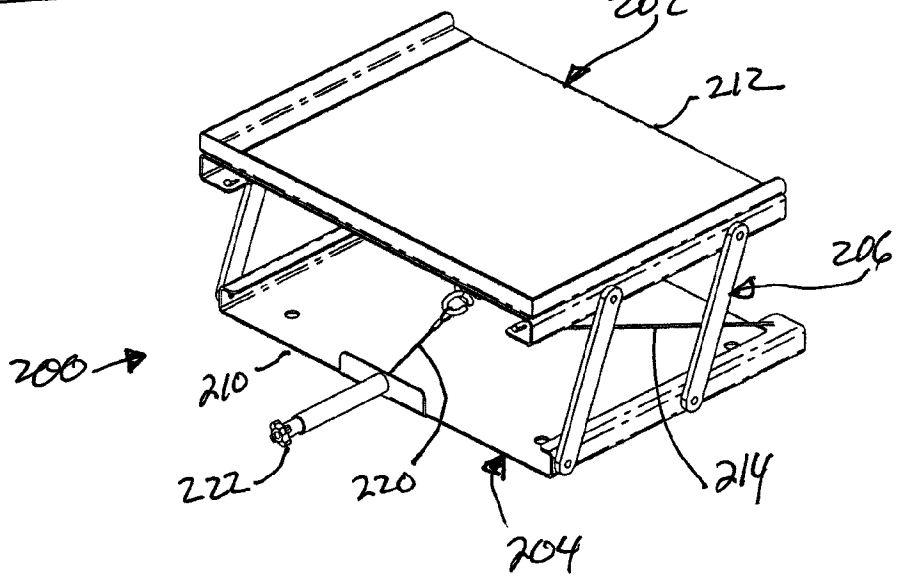
FIG. 9 is a perspective view of a foot isolation platform that is a third embodiment of the invention.
Figure 10:
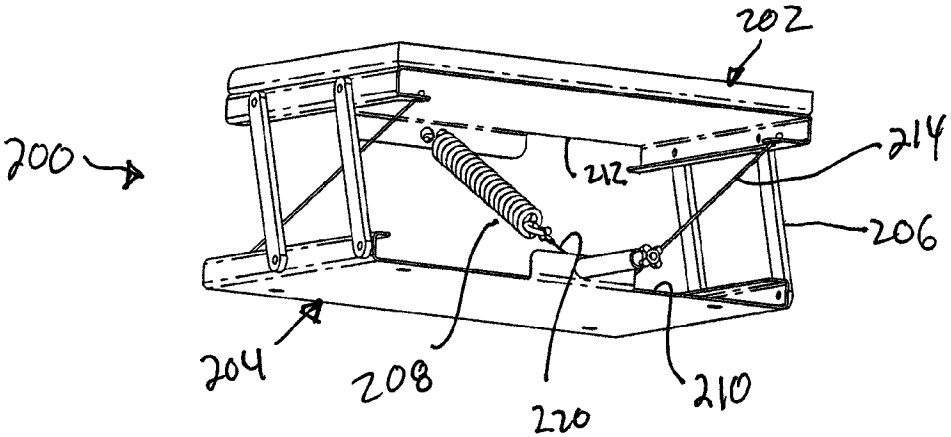
FIG. 10 is another perspective view of the foot isolation platform of FIG. 9.

FIGS. 9 and 10 illustrate a platform 200 that is a third embodiment of the invention. The platform 200 is generally similar to the platform 100 shown in FIGS. 7 and 8 and includes a foot support 202 and a base 204 that are connected by a four bar linkage system 206 and an extension spring 208.

In contrast to the platform 200 shown in FIG. 7, one end of the spring 208 is connected with a "pulling" cable 220, instead of directly with the edge 210 of the base 204. When the cable 220 is slack, the spring 208 is "free" at that one end and cannot pull the platform 200 open, and so the platform is collapsed. When the cable 220 is pulled far enough, it tensions the spring 208, and the spring can start to pull on the opposite platform edge 212, opening (raising) the platform 200, as discussed above with respect to the platform 100 shown in FIGS. 7 and 8.

Varying the amount of cable 220 which is pulled stretches the spring 208 more or less, thus varying the effective spring force acting between the base 204 and the foot support 202. The system can be set at different "pulling distances", each of which provides a different amount of resistance to collapsing. The length of the cable 220 can be effectively varied, in one example, by turning a knob or other adjustment device 222 that is attached (in a manner not shown) to the cable.

Cables or tethers 214 are employed, as discussed above with respect to the platform 100 shown in FIGS. 7 and 8, to manually collapse the platform 200 against the resistance of the spring 208.

FIGS. 11 and 12 illustrate a platform 300 that is a fourth embodiment of the invention. The platform 300 is generally similar to the platform 100 shown in FIGS. 7 and 8 and includes a foot support 302 and a base 304 that are connected by a four bar linkage system 306. The platform also includes a spring 308. The spring 308 is a compression spring.

The inner end of the spring 308 is captured against the front edge 310 of the base 304. A cable 320 is connected between the back edge 312 of the foot support 302 and an element 322 that can pull on the outer end of the spring 308, to compress the spring against the base 304.

When the platform 300 is collapsed (not shown), for example by stepping down onto the foot support 302, the spring 308 is compressed between the base 304 and the element 322. When the collapsing force is removed, the spring 308 attempts to return to its free state, and lengthens, acting via the cable 320 to pull the two opposite platform edges 310 and 312 closer together. Because of the geometry of the linkage 306, this causes the foot support 302 to rise off the base 304.

The platform 300 may again include cables or tethers 314 that are connected with the platform pieces 302 and 304 and are that arranged so that manually pulling on them acts against the force of the spring 308 to collapse the platform.

FIG. 13 illustrates a foot isolation platform 10*a* that is a fifth embodiment of the invention. The platform 10*a* is generally similar in construction to the platform 10 (FIGS. 1-6) and parts that are the same or similar are given the same reference numerals with the suffix "a" added to distinguish them.

The platform 10*a* (FIG. 13), like the platform 10, uses two pairs of retraction cables 56 and 58, to move the platform from the extended position to the retracted position. The cables 56 and 58 are routed differently, however, running generally vertically between the platform base 14*a* and the foot support 12*a*. This configuration of cables may operate more efficiently and smoothly than the angled configuration shown with respect to the platform 10*a*. This configuration of cables is one example of the retraction mechanisms, including but not limited to cable mechanisms, that are possible as alternatives to the retraction mechanism shown with respect to the platform 10.

Another advantage of the present invention over, for example, an airbag system, is the structural stability that is provided. A foot isolation platform that is supported by airbags is inherently unstable—it can move laterally, tip, etc. In contrast, a platform that is supported by structural materials, such as metal or composites, is inherently more stable—controlling the direction and displacement of travel In the context of a vehicle traveling off-road, such as a military vehicle, this can be a key benefit.

In at least some of the embodiments, the amount of spring force provided by the springs can be tailored. Obviously some spring force is needed to hold the platform up. But a high spring force could provide high resistance to compression in a mine blast event, transmitting the force of the blast upward into the occupant's lower extremities. To avoid this detrimental result, the spring force can be kept low enough that it will allow the base to move upward toward the foot platform relatively easily, even though this might result in a quick "bottoming out" of the platform. An appropriate balance is struck in designing the platform, based on all known considerations relating to safety of the occupants of the vehicle in which the platform is used.

In contrast, with an airbag system, a given force of air pressure is required to provide a given platform height. This does not allow for tailoring of the spring force. But with structural materials such as a metal or composite spring, the platform height and spring force are independent variables, and can be set separately as desired.

The invention claimed is:

1. A foot isolation platform for use by an occupant of a vehicle to help protect the lower extremities of the vehicle occupant in the event of rapid vertical upward movement of a floor of the vehicle, the platform comprising:

a base for connection with the vehicle floor to be movable with the vehicle floor;

a foot support movable vertically relative to the base and having an upper surface for supporting the feet of the vehicle occupant above the base; and an isolation member connected in a force-transmitting relationship between the base and the foot support, the isolation member supporting the foot support in an extended position vertically above the base, the isolation member acting to isolate the foot support from the vehicle floor in the event of rapid vertical upward movement of the vehicle floor thereby to help protect the lower extremities of the vehicle occupant.

2. A foot isolation platform as set forth in claim 1 that is non-pneumatic.

3. A foot isolation platform as set forth in claim 1 wherein the isolation member itself provides the motive force that moves and holds the foot support up off the base.

4. A foot isolation platform as set forth in claim 1 including a manually actuatable, non-pneumatic retraction mechanism for selectively and positively moving the foot support from the extended position to a retracted position.

5. A foot isolation platform as set forth in claim 4 wherein the isolation member resiliently resists movement of the foot support from the extended position to the retracted position.

6. A foot isolation platform as set forth in claim 1 wherein the isolation member comprises at least one spring that acts between the base and the foot support and that supports the foot support in the extended position.

7. A foot isolation platform as set forth in claim 6 wherein the spring is compressible at a substantially constant spring rate during movement of the foot support from the extended position into a retracted position closer to the base.

8. A foot isolation platform as set forth in claim 6 wherein the spring is a leaf spring.

9. A foot isolation platform as set forth in claim 1 wherein the dimensions of the foot support are selected to provide an upper surface suitable for use by only one vehicle occupant, and not large enough to provide an upper surface for the entire floor of the vehicle.

10. A foot isolation platform as set forth in claim 1 wherein all the components of the platform are made from a structural material such as metal.

11. A foot isolation platform as set forth in claim 8 including a manually actuatable, non-pneumatic retraction mechanism for selectively and positively moving the foot support from the extended position to a retracted position.

12. A foot isolation platform as set forth in claim 11 wherein the retraction mechanism comprises a plurality of retraction cables that interconnect the base and the foot support and that when pulled cause movement of the foot support from the extended position to the retracted position.

13. A foot isolation platform as set forth in claim 1 wherein the isolation member comprises a first group of leaf springs that project upward from one edge of the base and a second group of leaf spring that project upward from the opposite edge of the base, and wherein the foot support engages, near its opposite edges, the upper ends of the leaf springs.

* * * * *